US008176640B2

(12) United States Patent
Gullicks et al.

(10) Patent No.: US 8,176,640 B2
(45) Date of Patent: May 15, 2012

(54) MEDIA CUTTING DEVICE

(75) Inventors: Scott D. Gullicks, Apple Valley, MN (US); Gerald E. Mueller, Eagan, MN (US); Joy A. Packard, Somerset, WI (US); Scott D. Pearson, Woodbury, MN (US)

(73) Assignee: 3M Innovative Property Company, St. Paul, MN (US)

( * ) Notice: Subject to any disclaimer, the term of this patent is extended or adjusted under 35 U.S.C. 154(b) by 147 days.

(21) Appl. No.: 11/408,781

(22) Filed: Apr. 21, 2006

(65) Prior Publication Data

US 2006/0236550 A1 Oct. 26, 2006

Related U.S. Application Data

(63) Continuation-in-part of application No. 11/408,781, filed on Apr. 21, 2006.

(60) Provisional application No. 60/673,824, filed on Apr. 22, 2005, provisional application No. 60/699,905, filed on Jul. 15, 2005.

(51) Int. Cl.
*B26B 27/00* (2006.01)

(52) U.S. Cl. ..... 30/294; 30/2; 30/280

(58) Field of Classification Search ..... 30/2, 278, 30/280, 286, 289–291, 294, 295, 314, 317; 493/459, 462

See application file for complete search history.

(56) References Cited

U.S. PATENT DOCUMENTS 615,094 A 2/1894 Payne
521,115 A 6/1894 Hopper
838,852 A 12/1906 Eckley
1,099,885 A 6/1914 Peple
1,399,924 A * 12/1921 Berthelsen ..... 30/289
1,566,878 A * 12/1925 Jones ..... 30/290
2,050,768 A 8/1936 Seymour
2,274,978 A 3/1942 Currier
2,294,018 A * 8/1942 Borst ..... 30/294
2,329,805 A * 9/1943 Wilson, Sr. ..... 30/90.4
2,388,695 A 11/1945 Kriewaldt
2,389,648 A * 11/1945 Stafford ..... 30/151
2,428,490 A 10/1947 Goughnour (Continued)

FOREIGN PATENT DOCUMENTS

DE 3614860 A1 11/1987

(Continued)

OTHER PUBLICATIONS

"Film & Sheet Safety Cutters," Martor USA [on line], [retrieved from the internet Apr. 11, 2005], URL <http://www.martorusa.com/s.nl/sc.2/category.8/.f>, pp. 1-4.

(Continued)

*Primary Examiner* — Edward Landrum

(74) *Attorney, Agent, or Firm* — Kevin W. Weber; Lisa P. Fulton

(57) ABSTRACT

The present invention pertains to a device for cutting media, such as paper, cardboard, and metal foils. The device has a body that includes a sidewall extending from the body. The device has means for cutting the media disposed in the body. The means for cutting the media has a cutting edge having a leading edge and a trailing edge. The sidewall shrouds at least a portion of the cutting edge. The sidewall has a media contact point that is disposed away from the trailing edge in the direction of the leading edge.

17 Claims, 8 Drawing Sheets

U.S. PATENT DOCUMENTS

| | | | | |
|---|---|---|---|---|
| 2,571,234 | A | | 10/1951 | Guest |
| 2,597,540 | A | | 5/1952 | Smith |
| 2,610,399 | A | | 9/1952 | Adams et al. |
| 2,645,007 | A | * | 7/1953 | Alfredsson et al. ..... 30/2 |
| 3,028,670 | A | | 4/1962 | Tilly |
| 3,159,913 | A | | 12/1964 | Winton |
| 3,230,620 | A | | 1/1966 | Embleton |
| 3,365,798 | A | | 1/1968 | Cunningham |
| 3,374,541 | A | | 3/1968 | Earnest, III et al. |
| 3,613,241 | A | | 10/1971 | Allen |
| 3,673,687 | A | | 7/1972 | Phillips et al. |
| D230,007 | S | | 1/1974 | Cramer |
| 3,815,231 | A | | 6/1974 | Greenberg |
| 3,824,688 | A | | 7/1974 | Goffe |
| 3,835,536 | A | | 9/1974 | Marcoux |
| 3,883,953 | A | | 5/1975 | Saullo et al. |
| 4,001,934 | A | | 1/1977 | Bell |
| 4,106,196 | A | | 8/1978 | Smithline |
| 4,134,206 | A | | 1/1979 | Beermann |
| D254,243 | S | | 2/1980 | Florian et al. |
| 4,373,263 | A | | 2/1983 | Ayers |
| D269,154 | S | | 5/1983 | Freedman et al. |
| 4,581,823 | A | | 4/1986 | Gilman |
| D291,651 | S | | 9/1987 | Sieg et al. |
| 4,831,734 | A | | 5/1989 | De Ruyter et al. |
| D305,499 | S | | 1/1990 | Walker |
| 4,980,942 | A | | 1/1991 | Spargo, Sr. |
| D320,150 | S | | 9/1991 | Huang |
| 5,046,253 | A | | 9/1991 | Ireland |
| 5,054,699 | A | | 10/1991 | DeJaynes |
| 5,072,515 | A | | 12/1991 | Heitz |
| D323,967 | S | | 2/1992 | Talbot |
| 5,205,007 | A | | 4/1993 | Goldstein |
| 5,232,132 | A | | 8/1993 | Broussard et al. |
| 5,285,575 | A | * | 2/1994 | Hirano ..... 30/2 |
| 5,400,452 | A | | 3/1995 | Goldstein |
| D362,168 | S | | 9/1995 | Mancini |
| 5,480,080 | A | | 1/1996 | Ferguson |
| 5,564,145 | A | | 10/1996 | Goldstein |
| 5,638,603 | A | | 6/1997 | Li |
| 5,662,669 | A | | 9/1997 | Abidin et al. |
| 5,697,938 | A | | 12/1997 | Jensen et al. |
| 5,724,738 | A | | 3/1998 | Ballarini |
| 5,737,842 | A | | 4/1998 | Freedman |
| 5,758,422 | A | | 6/1998 | Frank |
| 5,768,787 | A | | 6/1998 | Ireland |
| 5,809,656 | A | | 9/1998 | Lindberg |
| 5,896,667 | A | | 4/1999 | Hawkins |
| 5,964,388 | A | * | 10/1999 | Jennings et al. ..... 30/2 |
| 5,983,505 | A | | 11/1999 | Gibson |
| 6,003,181 | A | | 12/1999 | Wenk |
| D423,318 | S | | 4/2000 | Lacy |
| D424,397 | S | | 5/2000 | Wiseman |
| 6,131,223 | A | | 10/2000 | Rehkemper et al. |
| 6,240,645 | B1 | | 6/2001 | Ozeki |
| 6,371,844 | B1 | | 4/2002 | Holler |
| 6,493,945 | B1 | * | 12/2002 | DeRosa et al. ..... 30/286 |
| 6,578,266 | B2 | | 6/2003 | Chomiak |
| 6,615,495 | B1 | | 9/2003 | Evens et al. |
| D481,609 | S | | 11/2003 | Perlmutter et al. |
| 6,941,664 | B1 | | 9/2005 | Engle et al. |
| D514,916 | S | | 2/2006 | Craig |
| 7,003,884 | B2 | | 2/2006 | Perlmutter et al. |
| D525,852 | S | | 8/2006 | Pearson et al. |
| D527,603 | S | | 9/2006 | Gullicks et al. |
| 2003/0213133 | A1 | | 11/2003 | Hanna |
| 2004/0088868 | A1 | | 5/2004 | Fazio |
| 2006/0236550 | A1 | | 10/2006 | Gullicks et al. |
| 2007/0245571 | A1 | | 10/2007 | Pearson |

FOREIGN PATENT DOCUMENTS

| | | | |
|---|---|---|---|
| DE | 196 54 034 | | 7/1997 |
| DE | 202 14 317 | U1 | 9/2002 |
| EP | 771256 | B1 | 9/1999 |
| FR | 965628 | | 9/1950 |
| JP | 05-318333 | | 12/1993 |
| JP | 10-295953 | | 11/1998 |
| JP | 2915902 | | 4/1999 |
| JP | 2001-62162 | | 3/2001 |
| JP | 2001-198368 | | 7/2001 |
| JP | 2001-259256 | | 9/2001 |
| KR | 20-0240124 | | 7/2001 |
| KR | 20-0243780 | | 8/2001 |
| WO | WO 95/35190 | | 12/1995 |
| WO | WO 01/14108 | A1 | 3/2001 |

OTHER PUBLICATIONS

"Snitty (On Card)—43037," Martor USA [on line], [retrieved from the internet Apr. 7, 2005], URL <http://www.martorusa.com/s.nl/sc.2/category.8/it.A/id.640/.f>, pp. 1-2 and 1.

"The Amazing Open X®," [on line], [retrieved from the internet Jun. 20, 2005], URL <http://www.myopenx.com/guarantee.htm>, pp. 1.

"World's Best Gift Wrap Cutter," New Design Inc., Vernon Hills, IL 60061, brochure, pp. 1-4.

"The Ribbon-Master®" from Group One Limited, [retrieved from the internet Dec. 5, 2005], URL http://www.grouponelimited.com/rib_mast.htm, pp. 1-4.

"The Mini-Master™", from Group One Limited, [retrieved from the internet Dec. 5, 2005], URL http://www.grouponelimited.com/mini_mas.htm, pp. 1-3.

* cited by examiner

MEDIA CUTTING DEVICE

CROSS REFERENCE TO RELATED APPLICATIONS

This application is a continuation-in-part of U.S. application Ser. No. 11/408,781, filed Apr. 21, 2006, which claims priority from U.S. Provisional Applications Ser. Nos. 60/673824, filed Apr. 22, 2005 and 60/699905 filed Jul. 15, 2005, the disclosures of which are incorporated by reference in their entirety herein.

FIELD OF INVENTION

The present invention relates to a media cutting device. In particular, the present invention relates to a hand held, portable, light weight device that is well suited for cutting media such as paper, plastic, metal films, fabrics, and cardboard box.

BACKGROUND

There are a wide variety of devices available for cutting media such as, e.g., paper, plastic sheets, aluminum foil, felt, and photos. Perhaps the most commonly used device for cutting such media is a scissor. While scissors are commonplace, they do have some drawbacks. For examples, scissors have exposed cutting edge, which can present safety hazards. In some instances, as with dull scissors, the media can bunch up and the resulting edge created by the cut may be jagged and unsightly. Such jagged edges are undesirable in some applications, such as, e.g., in gift-wrapping packages.

There are a wide variety of designs for envelope openers available commercially. These devices are especially useful for cutting along a fold such as an envelope opener. However, they are not as well suited to cut media that does not contain a fold. Other type of cutters can leave marks on the media, marks such as scratches and folds near the cut edge. These marks are usually undesirable to the consumer.

What is needed is a hand held cutting device that avoids the scissor action while providing ease of use.

SUMMARY

The present invention provides for a light-weight, hand held, portable media cutting device for cutting straight lines, patterns, or curves on media. Exemplary media includes, but is not limited to, paper (such as gift wrapping paper, wax paper, photo paper), plastic, metal film such as aluminum foils, fabrics such as felts, and cardboard. A user of the inventive device exerts minimal force on the media to cut it meaning that using the device, the user applies only the force necessary to cut the media. Thus, the user does not have to apply excessive compressive force onto the media, thereby pushing the device into the media. With the device, the user does not need to resort to a cutting mat to cut the media. Typically, a cutting mat is used where the cutting device has an exposed blade. The elimination of a cutting mat is especially useful in crafting applications.

In one aspect, the present invention pertains to a device for cutting media comprising (a) a body comprising a sidewall extending from the body; and (b) means for cutting the media disposed in the body, the means for cutting the media comprising a cutting edge having a leading edge and a trailing edge. The sidewall shrouds at least a portion of the cutting edge. With reference to the cutting edge, the sidewall comprises a media contact point that is disposed away from the trailing edge in the direction of the leading edge. In one embodiment, the sidewall does not extend beyond the leading edge of the cutting edge.

In another aspect, the present invention pertains to a media cutting device comprising (a) a body comprising a handle, a cover extending from the handle, and a sidewall extending from the cover, (b) a guide disposed generally beneath the cover and extending from the handle, and (c) a blade disposed in the guide, the blade having a leading edge and a trailing edge. The sidewall shrouds at least a portion of the blade. With reference to the blade, the sidewall comprises a media contact point that is disposed away from the trailing edge in the direction of the leading edge. In one embodiment, the sidewall does not extend beyond the leading edge of the blade.

In yet another aspect, the present invention pertains to a media cutting device having replaceable parts. This particular device comprises a head comprising a cover, a sidewall extending from the cover, and a guide disposed substantially under the cover, the guide having a blade disposed therein; a handle attached to the head; and means for engaging and disengaging the head from the handle.

In yet another aspect, the present invention pertains to a method of cutting media comprising the steps of (a) providing a device for cutting media comprising a body comprising a sidewall extending from the body; and means for cutting the media disposed in the body, the means for cutting the media comprising a cutting edge having a leading edge and a trailing edge, wherein the sidewall shrouds at least a portion of the cutting edge, and wherein the sidewall comprises a media contact point that is disposed away from the trailing edge in the direction of the leading edge; (b) providing media; and (c) sliding the device through the media thereby cutting it. During the cutting action, the sidewall and the cutting edge create a localized deformation in the media near the leading edge of the cutting edge.

As used herein, the "cutting edge" describes that portion of the means for cutting the media that cuts the media during use. As described in detail below, an exemplary means for cutting the media is a blade or a wire. The cutting edge may or may not be continuous. The entire length of the cutting edge may or may not be used during cutting. The "leading edge" describes a location on the cutting edge that first encounters the media when the device is used to cut the media. The "trailing edge" describes a location on the cutting edge that has the greatest change in elevation from the leading edge. The media has two major surfaces, a first surface and an opposite second surface. The "media contact point" of the sidewall describes general location where the sidewall makes contact with the first major surface of the media while the cutting edge makes contact with the second major surface of the media.

One advantage of the present invention relates to ease of use. Because the user simply pushes the device through a media, there is no opening and closing action like that of scissors and typically one uses less effort to cut the media. This advantage is well suited for users who may have difficulty with scissors, e.g., those users who may experience arthritis and especially young users.

Another advantage of the present invention relates to safety. While, in one embodiment, the means for cutting the media is replaceable, in many embodiments the cutting edge will not be exposed to the user when the device is used in its intended application. In one embodiment, the cutting edge can be rotated so as to expose a new area of the cutting edge when the existing area becomes dull.

Yet another advantage of the present invention is that it is versatile, meaning that it can cut straight lines as well as curves. This advantage means that the device is useful in many applications, such as, e.g., cutting gift-wrapping paper, cardboard boxes, fabrics, box sealing tape, etc. The device easily fits into the user's pockets, purse, or bag, and when the user reaches for the device, he or she will not be inadvertently cut by it due to the design. Furthermore, because, in some embodiments, the device has a substantially flat bottom and because of the low presentation of the cutting edge relative to the flat bottom, the device is suitable for cutting media supported by a tabletop or the like.

BRIEF DESCRIPTION OF THE DRAWINGS

The invention can further be described with reference to the following drawings, wherein.

The drawings are idealized, not drawn to scale, and are intended only for illustrative purposes.

DETAILED DESCRIPTION

Figure 1:
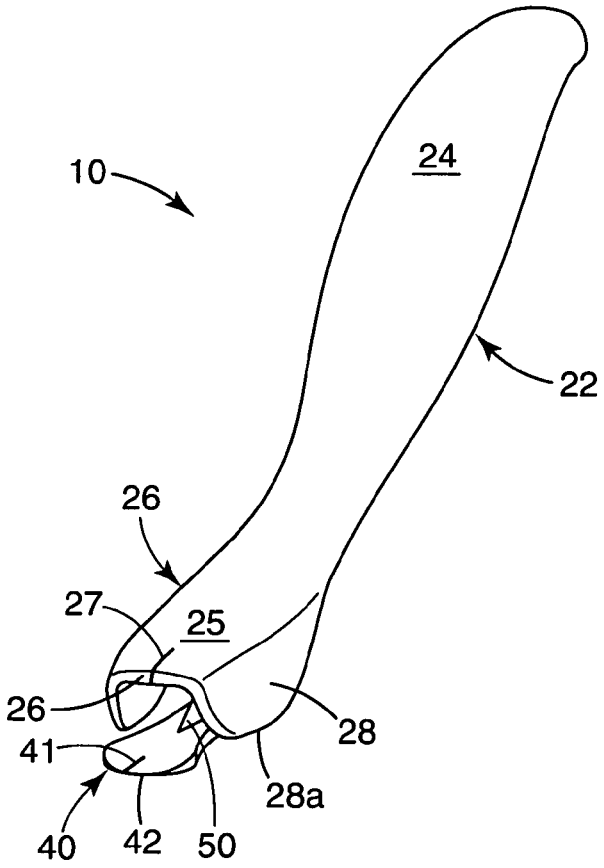
FIG. 1 is a perspective view of an exemplary embodiment of the present invention.
Figure 5:
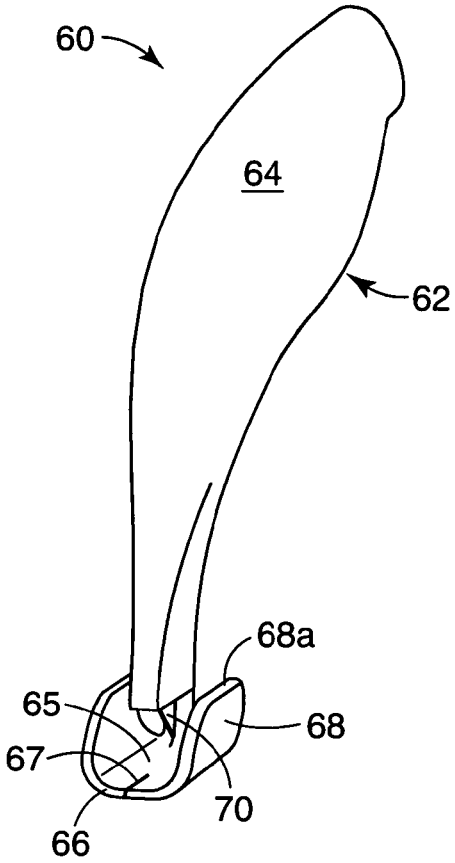
FIG. 5 is a perspective view of another exemplary embodiment of the present invention.

Referring generally to the embodiments in FIGS. 1 and 5, the device of the present invention 10, 60 includes body 22, 62, and sidewall 28, 68. The sidewall extends from the body. Although both embodiments show two sidewalls, the present invention can be practiced with one sidewall. The device further includes means for cutting the media. In the embodiments of FIGS. 1 and 5, the means for cutting the media is in the form of blade 50, 70. Although the embodiments in FIGS. 1 and 5 show the body to be an elongated, slender handle intended to be grasped by the user's palm, it is within the scope of the present invention for the body to be of other design. For example, the body could be oval or rectangular shaped and substantially flat so that it can be grasped between the user's thumb and forefinger. As yet another example, the body can be in the form of a "T" shaped bar, for grasping by the user's hand. To give some dimensions as examples and not as limitations, the body could have a length of about 4 to 6 inches (102 to 152 mm), and a width, at its widest point, of about 0.25 to 0.75 inches (6 to 19 mm).

Figure 2:
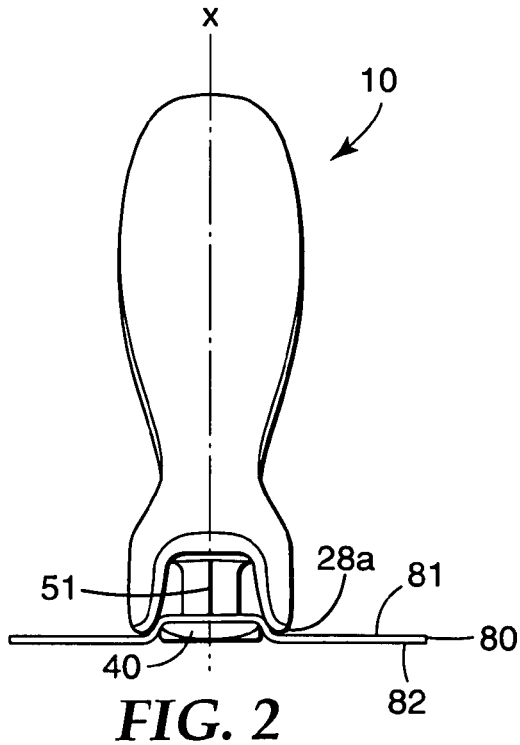
FIG. 2 is a front view of the embodiment of FIG. 1.

Referring now specifically to FIGS. 1 and 2, device 10 includes a body 22 and blade 50 disposed in optional guide 40. The body includes elongated handle 24, cover 25 extending from the handle, and sidewall 28 extending from cover. The cover has exposed end 26. Guide 40 includes free end 42. The device is shown in its cutting orientation, i.e., in its intended orientation when cutting the media. In one embodiment, the body, sidewall, and guide are integrally formed. It is within the scope of the present invention, however, for each of the three components to be formed separately and joined together by any suitable means.

In one exemplary embodiment, the cover and/or the guide can have a reference mark to help the user align the device with the media to facilitate accurate cutting. The reference mark can be especially useful where the media contains lines or patterns for the user to follow. In FIG. 1, reference mark 27 and 41 lie midway on the cover and guide respectively, although the reference mark can be in other location including the handle. In one embodiment, a visually guided mark is in the form of a light indicating means, such as a light emitting diode that projects a light beam onto the media. The light indicating means can be snapped onto the cutting device, or it can be an integral part of the cutting device. The light beam that projects onto the media may be colored, such as e.g., red or green light beams.

The body has a centerline, generally denoted as reference line "x". A portion of cover 25 is planar. The plane of the cover is generally coplanar to the plane of the media in regions away from the where the device has engaged the media. Other designs for the cover can be used to practice the present invention. If used, the guide lies below the sidewall. While sidewall 28 is shown to be generally trapezoidal in shape, it can be of any variety of geometry so long as it has a media contact point, denoted as reference 28*a*. The sidewall may have more than one media contact point. The sidewall extends from the cover so as to shroud at least a portion of blade 50. In this particular embodiment, the sidewall includes a curve in the region near the cover. The radius of curvature of the curve is relatively sharp, i.e., small radius, as the sidewall is nearly orthogonal to the plane of the cover. It is within the scope of the present invention to use a larger radius of curvature than what is shown in FIG. 1, so long as the sidewall has a media contact point. When the media lies horizontal, as best shown in FIG. 2, the device is operable even when it is rotated about its centerline so that the device and the media do not have to be at right angles to one another. FIG. 2 also shows that when the device engages media, at some point during the cutting process, media contact point 28*a* of the sidewall makes contact with first major surface 81 of the media while cutting edge 51 of the blade makes contact with second opposite major surface 82 of the media.

Figure 3:
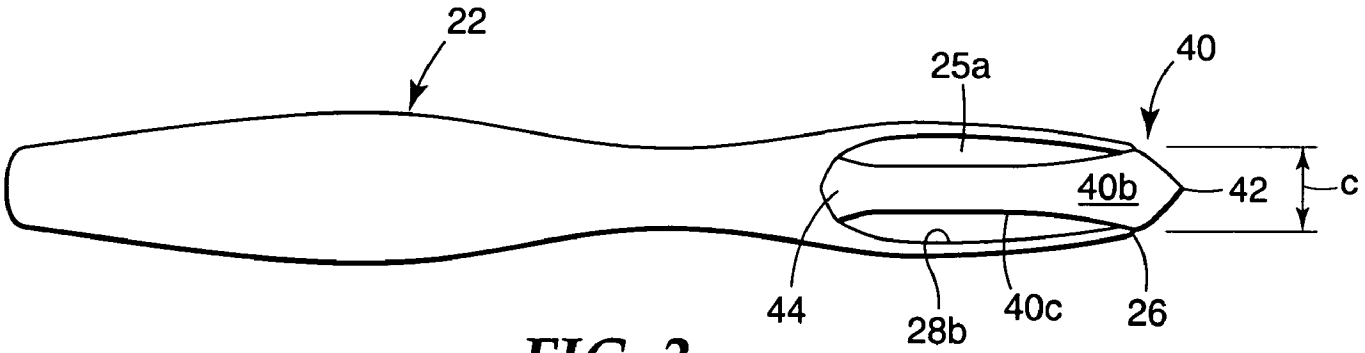
FIG. 3 is bottom plan view of the embodiment of FIG. 1.

FIG. 3 is a bottom view of the device showing, among other things, inside surface 25*a* of the cover along with optional guide 40 with its bottom surface 40*b* exposed to the reader. Free end 42 of the guide extends beyond exposed end 26 of the cover. While the guide shown in FIG. 3 has an elongated neck with a rounded free end, other designs for the guide can be used.

For example, the free end can be of a shorter length than what is shown in FIG. 3 not reaching to the exposed end of the cover. In one embodiment, the width of the free end as measured near the exposed end of the cover, denoted generally as "c", is larger than the width of the sidewall near the same point. In other embodiments, the width of the guide, taken at any distance from the attached end of the guide, can be greater or less than the widest width of the sidewall. In one embodiment, the largest distance between inside surface 28*b* of sidewall 28 to the edge 40*c* of the guide is sufficiently small so as to prevent the user from inserting his or her finger into that region. This design feature is intended to deny the user access to the cutting edge of the blade. In this embodiment, the free end of the guide is pointed, so as to allow piercing of the media. The piercing provides another method for starting the cutting process.

Near attached end 44, the guide is tapered: The attached end can also be narrowed as compared to the rest of the guide. These design features facilitate the cutting process, as the tapered or narrowed regions allow for easy passage of the media away from the device reducing hang up and/or distortion of the cut media. In one embodiment, bottom surface 40*b* of the guide can include extensions, such as a rib (FIG. 13), that would fit into a corresponding mating channel on a cutting surface. For example, in some fabric stores, a salesperson cuts a piece of fabric on a countertop that has grooves or channels to guide the cutting device used, so as to cut as straight of a line as possible. The rib can also be attached to one side of the guide, to register it from an edge, again in an effort to cut as straight of a line as possible.

As can be seen from FIG. 3, the sidewalls are curved in cross-section. Thus, the sidewall has compound curves, the first being the curved surface near the cover and the second being the cross-sectional curvature of the sidewall. The sidewall can be rigid so as to be stiff and unyielding in use or it can be flexible so as to deflect when used with the media.

Figure 4:
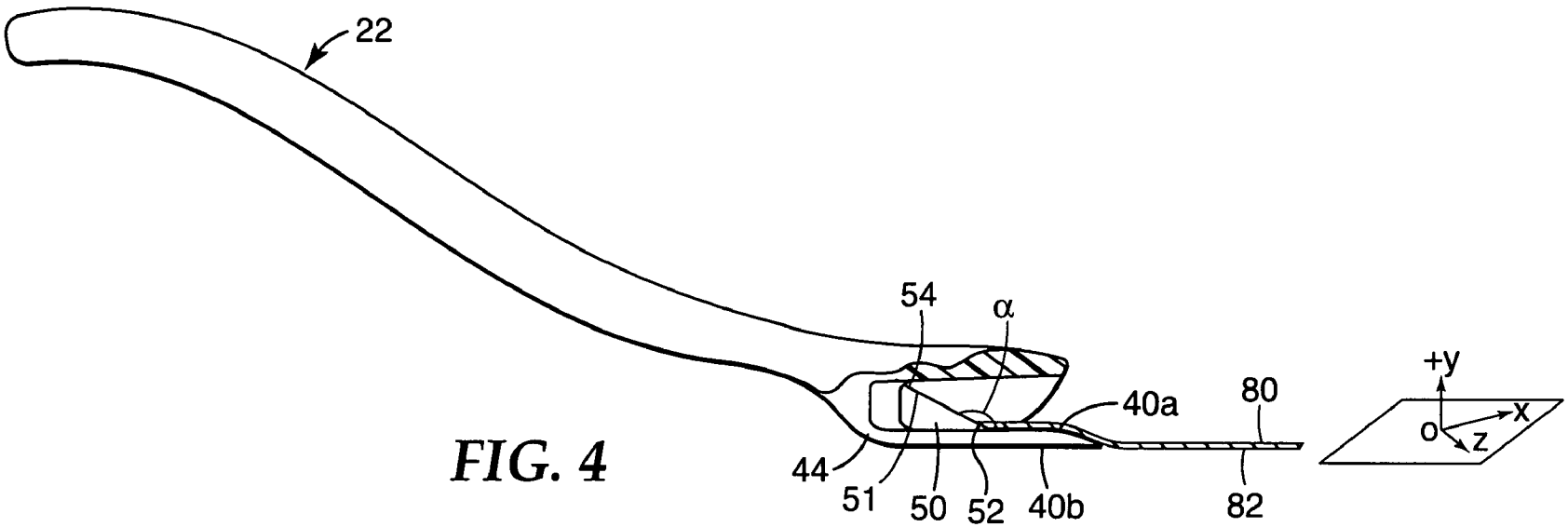
FIG. 4 is a side view of the embodiment of FIG. 1 with a portion of the sidewall cut away for illustrative purposes.

FIG. 4 shows a side view of the cutting device with a portion of the sidewall cut away for ease of understanding. Optional guide 40 has a top surface 40*a* opposite from bottom substantially planar surface 40*b*, which is coplanar to the horizontal plane of the media. The guide can facilitate pick up of the media and, as stated previously, can function as a visual aid to help align the device with the media. Attached end 44 of the guide extends from the handle. Blade 50 is disposed in the guide such that its cutting edge 51 is exposed to the media. The cutting edge has leading edge 52 and trailing edge 54. In this particular embodiment, leading edge 52 lies proximate to top surface 40*a* while trailing edge 54 lies near attached end 44. The media contact point of the sidewall is disposed away from trailing edge 54 in the direction of leading edge 52. In one embodiment, the media contact point on the sidewall lies between the leading edge and the trailing edge. In another embodiment, the media contact point of the sidewall extends beyond the leading edge of the blade but not beyond bottom surface 40*b* of the guide.

FIG. 4 also shows that when media 80 contacts cutting edge 51, an angle $\alpha$ is created between second major surface 82 of the media and the cutting edge. The device is operable when the angle $\alpha$ is any value except about 180°, which is the case where the cutting edge is parallel to the horizontal plane of the media.

For reference purposes, a Cartesian coordinate system is presented in FIG. 4 where intersecting axes x and z define a plane and axis y is orthogonal to the x and z axes. An origin, O, defines the intersection of the three axes. When the origin coincides with leading edge 52, with the x-z plane lying substantially coplanar with surface 40*a*, trailing edge 54 lies in the positive y (+y) direction, which is illustrated, in FIG. 4, to be above the x-z plane.

Figure 12:
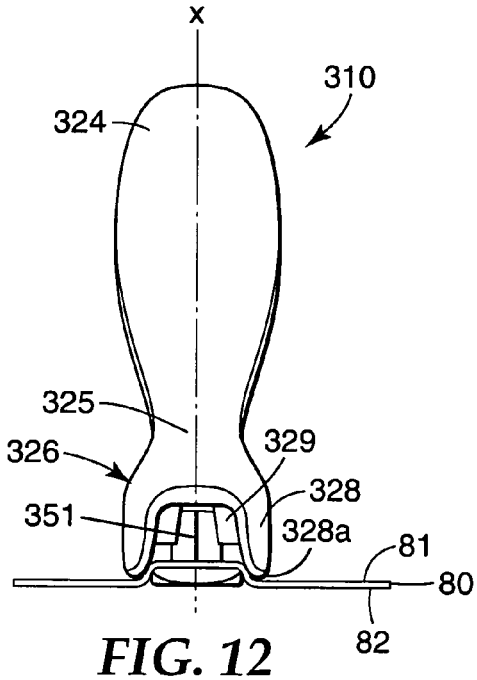
FIG. 12 is a front view of another embodiment of the present invention.

FIG. 12 shows another exemplary embodiment of the present invention. Similar to the embodiment of FIG. 1, cutting device 310 includes handle 324 and housing 326. The housing includes cover 325 and sidewall 328. When the device engages media, at some point during the cutting process, first media contact point 328*a* of the sidewall makes contact with first major surface 81 of media 80 while cutting edge 351 makes contact with second opposite major surface 82. As the device slides through the media during cutting, the media may travel along the cutting edge eventually to encounter second media contact point 329. Among the various functions of the second media contact point, it serves a way to minimize the possibility that uncut media will gather at the trailing edge of the blade, which would cause tearing in the media. In other words, with the use of the second media contact point, the media will most likely be cut before it reaches the trailing edge of the blade.

Figure 13:
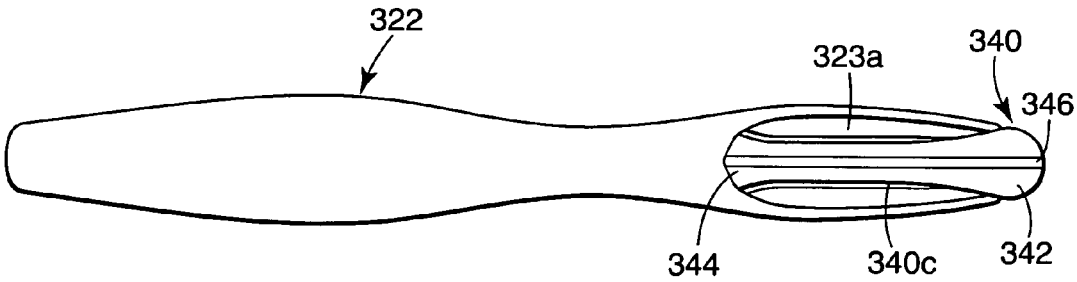
FIG. 13 is a bottom plan view of the embodiment of FIG. 12.

FIG. 13 is a bottom view of the device of FIG. 12 showing guide 340 and inside surface 323*a* of the housing. The guide further includes rib 346 extending substantially from attached end 344 to free end 342 of the guide. The second media contact point is disposed on an inside surface of the housing. The second media contact point can extend from the cover, from the sidewall, or from the combination thereof. Whether or not the media will encounter the second media contact point during the cutting operation depends upon several factors, including but not limited to, the weight and or thickness of the media, the speed of cutting, and the orientation of the cutting edge with respect to the media.

FIGS. 5 to 8 show another exemplary embodiment of the present invention where device 60 is shown in its cutting orientation. The device includes body 62 and blade 70 disposed in the body. In this particular embodiment, the body is in the form of an ergonomically designed handle 64 with a substantially planar base 65. The body also includes transition zone 63 (FIG. 7) that connects the handle to the base. The plane that defines the base is substantially coplanar with the plane of the media. Sidewall 68 extends from the base to shroud at least a portion of a cutting edge of the blade. The sidewall can be of any geometry so long as it has a media contact point, denoted as reference 68a. In one embodiment, the base includes reference mark 67 to help the user align the device with the media. In FIG. 5, reference mark 67 lies midway on the base, although the reference mark can be in other location. In one embodiment, the handle, transition zone, and base are integrally formed. It is within the scope of the present invention to have each component formed separately and then joined together by any suitable means. The base also has first exposed end 66, which is the end that includes a direct line of sight to the cutting edge. The device also has a second exposed end, as can be seen in the rear view of FIG. 7. The body has a centerline, generally denoted as reference line "y".

Figure 6:
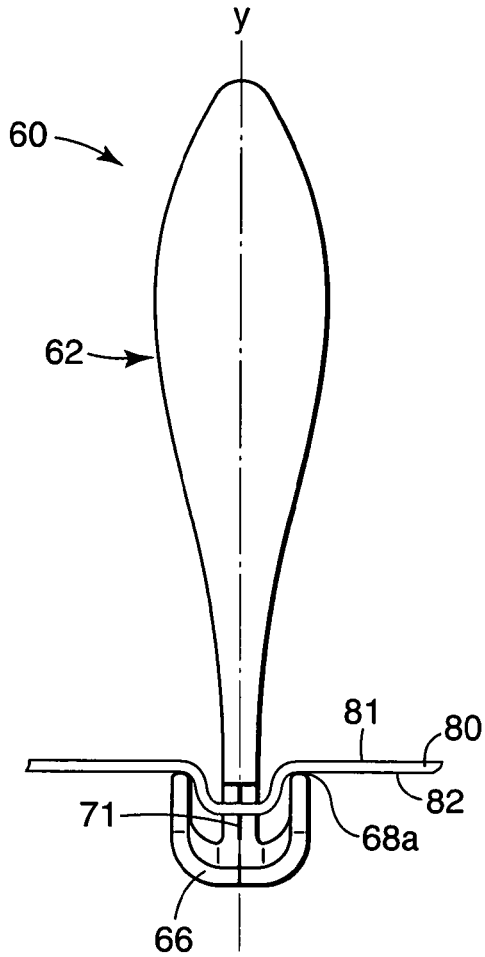
FIG. 6 is a front view of the embodiment of FIG. 5.
Figure 7:
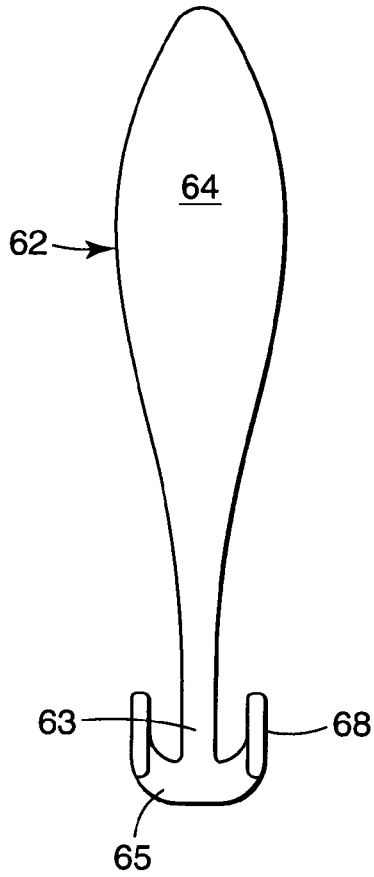
FIG. 7 is a back view of the embodiment of FIG. 5.

With reference to FIG. 6, when the device engages media 80, at some point during the cutting process, media contact point 68*a* of the sidewall makes contact with second major surface 82 of media 80 while cutting edge 71 makes contact with an opposite first major surface 81. FIG. 7 shows a back view of the device where transition zone 63 is tapered or narrowed. Similar to the tapered or narrowed attached end of the guide in the embodiment of FIG. 1, the tapered or narrowed transition zone allows for easy passage of the media away from the device and can also reduce hang up and/or distortion of the cut media.

Figure 8:
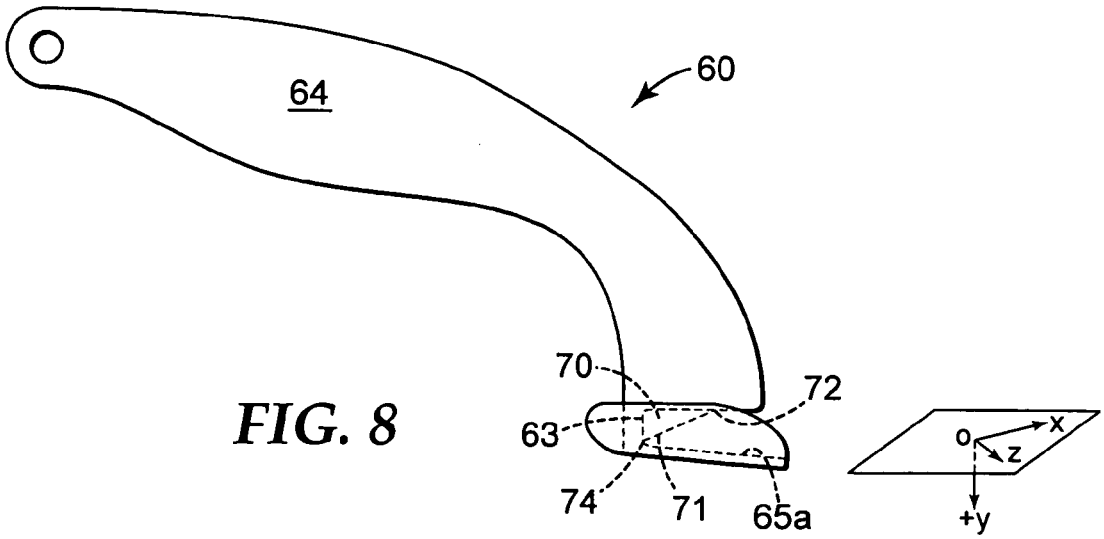
FIG. 8 is a side view of the embodiment of FIG. 5 with hidden features shown in phantom.

With reference to FIG. 8, blade 70 is disposed in the transition zone. The blade has cutting edge 71, leading edge 72, and trailing edge 74. Media contact point 68*a* of the sidewall is disposed away from trailing edge 74 in the direction of leading edge 72. In one embodiment, the media contact point lies between the leading edge and the trailing edge. In another embodiment, the media contact point on the sidewall extends beyond the leading edge. A Cartesian coordinate system is presented in FIG. 8 for reference purposes. When the Cartesian coordinate system is placed so that the origin coincides with leading edge 72, trailing edge 74 lies in the positive y (+y) direction.

Figure 9:
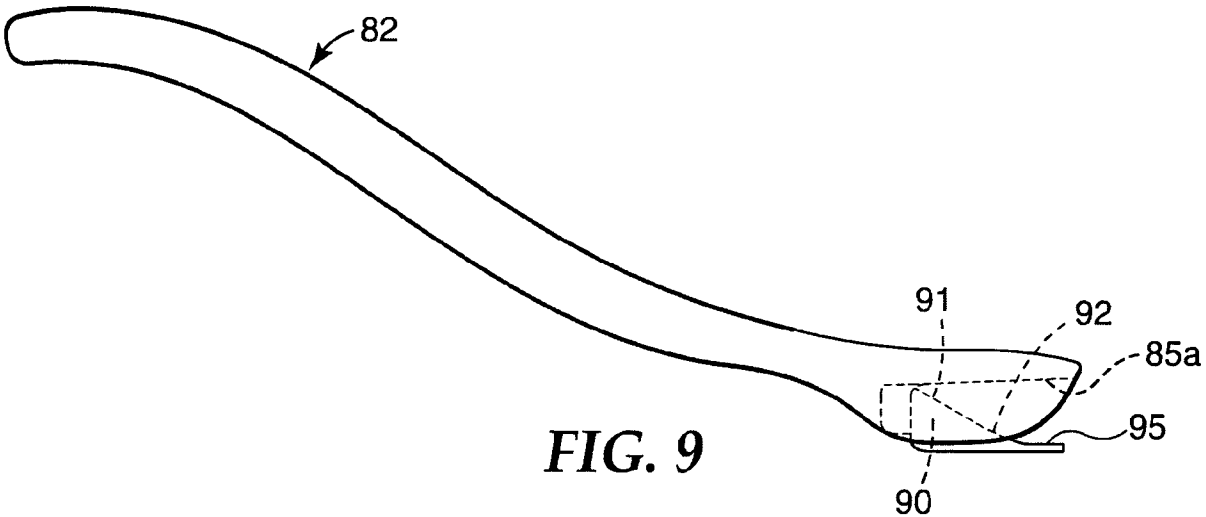
FIG. 9 is a perspective view of another exemplary embodiment of the present invention with hidden features shown in phantom.

FIG. 9 shows another exemplary embodiment of the present invention similar to the embodiment shown in FIG. 4. The embodiment in FIG. 9 includes a body 82 and blade 90 disposed in the body. The blade has cutting edge 91 and non-cutting portion 95. The cutting edge has leading edge 92 and trailing edge 94, which is disposed near inner surface 85*a* of the cover. The non-cutting portion of blade cab facilitate the lifting of the media into the cutting edge of the device.

In use, typically the device engages an edge of the media. As the device slides further into the media, the cutting edge in combination with the sidewall, particularly the media contact point on the sidewall, deforms the media so that it no longer lies in one continuous plane from one side of the device to the other side of the device. The deformation occurs in the area of the media that is presented to the cutting edge (the "presented area"). In the embodiments of FIGS. 1, 5, and 9, the presented area is the area between the sidewalls and on that portion of the cutting edge that makes contact with the media. In the embodiment where only one side wall is present, the presented area is the region between the sidewall and the cutting edge that has made contact with the media. The magnitude of the deformation is determined by factors such as, e.g., the weight, stiffness, and thickness of the media, and the location of the media contact point with respect to the trailing edge. There may be other factors that determine the magnitude of the deformation. In one embodiment, during the cutting process, the media does not come into contact with inside surface of the cover, shown generally reference numbers 25*a* and 65*a* in FIGS. 3 and 8 respectively of the two embodiments. During the cutting process, the sidewall may exert various frictional forces on the media. There is at least one frictional force that opposes the media from riding up the cutting edge.

In another aspect, the present invention relates to a cutting device containing replaceable parts. For example, in the embodiment of FIG. 1, the cover and sidewall may be integrally formed and the combination may be replaceable so as to accommodate different types of media. The guide may be replaceable to introduce a new cutting edge. The handle may be replaceable. Similarly, for the embodiment in FIG. 5, the base and sidewall may be integrally formed and the combination may be replaceable so as to accommodate different types of media. The transition zone may be replaceable to introduce a new cutting edge.

Figure 10A:
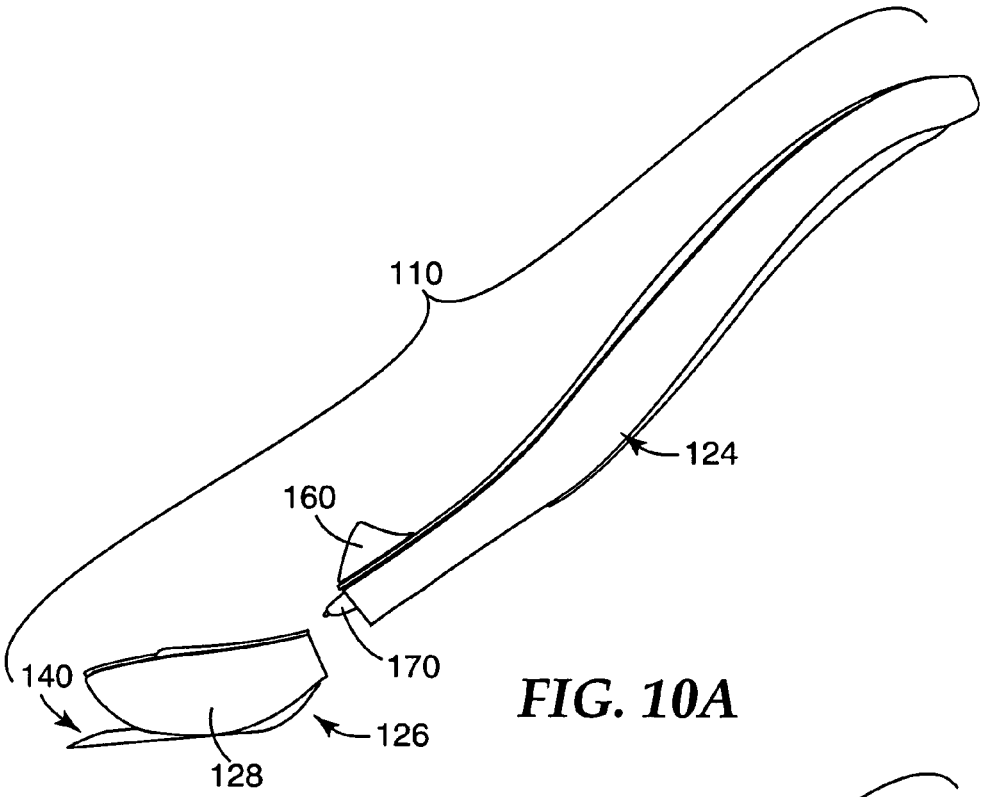
FIGS. 10A and 10B are side views of various embodiments showing a cutting device with replaceable parts.
Figure 10B:
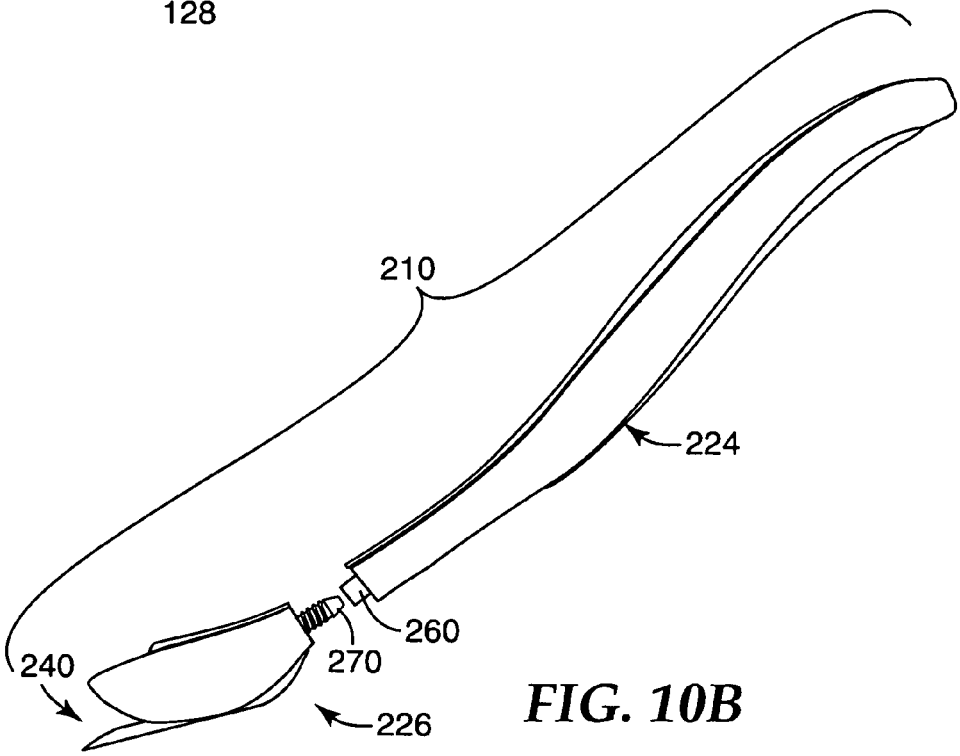

FIGS. 10A and 10B show exemplary cutting devices with replaceable parts. In FIG. 10A, cutting device 110 includes handle 124 and housing 126 that can be attached together using male part 170 in the handle and mating female part (not shown) in the housing. The housing includes a cover and sidewall 128 and optionally guide 140. The housing can be engaged and disengaged from the handle using any of a variety of mechanical means, and FIG. 10A shows the use of tab 160 as a convenient way for the consumer to disassemble the head from the handle. In FIG. 10B, cutting device 210 includes handle 224 and housing 226 that can be attached together using a combination of threaded screw 270 disposed on the head and receptacle 260 on the handle for receiving the threaded screw. Other mechanical devices can be used attach the two parts, such as, e.g., a ball and socket or a key way, allowing them to be snapped together or apart.

Figure 11:
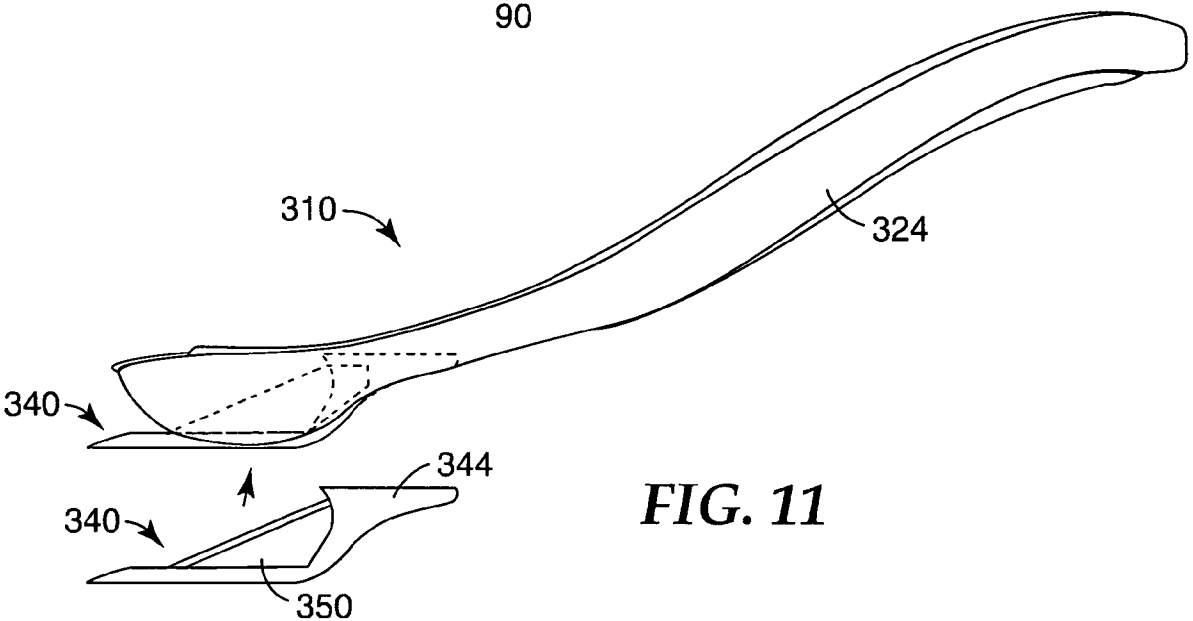
FIG. 11 is a side view of an embodiment showing the cutting device with replaceable guide and blade.

FIG. 11 shows another illustrative embodiment where the guide is replaceable. Cutting device 310 includes handle 324 and replaceable guide 340 having blade 350. In use, when the blade becomes dull or when the blade needs to be changed due to cutting a new media, the user would disengage the guide from the handle and install a new or different guide. The replaceable guide can disassembled from the handle at attached end 344 and the handle would have a corresponding means to allow for the engaging and disengaging of the guide.

Figure 14:
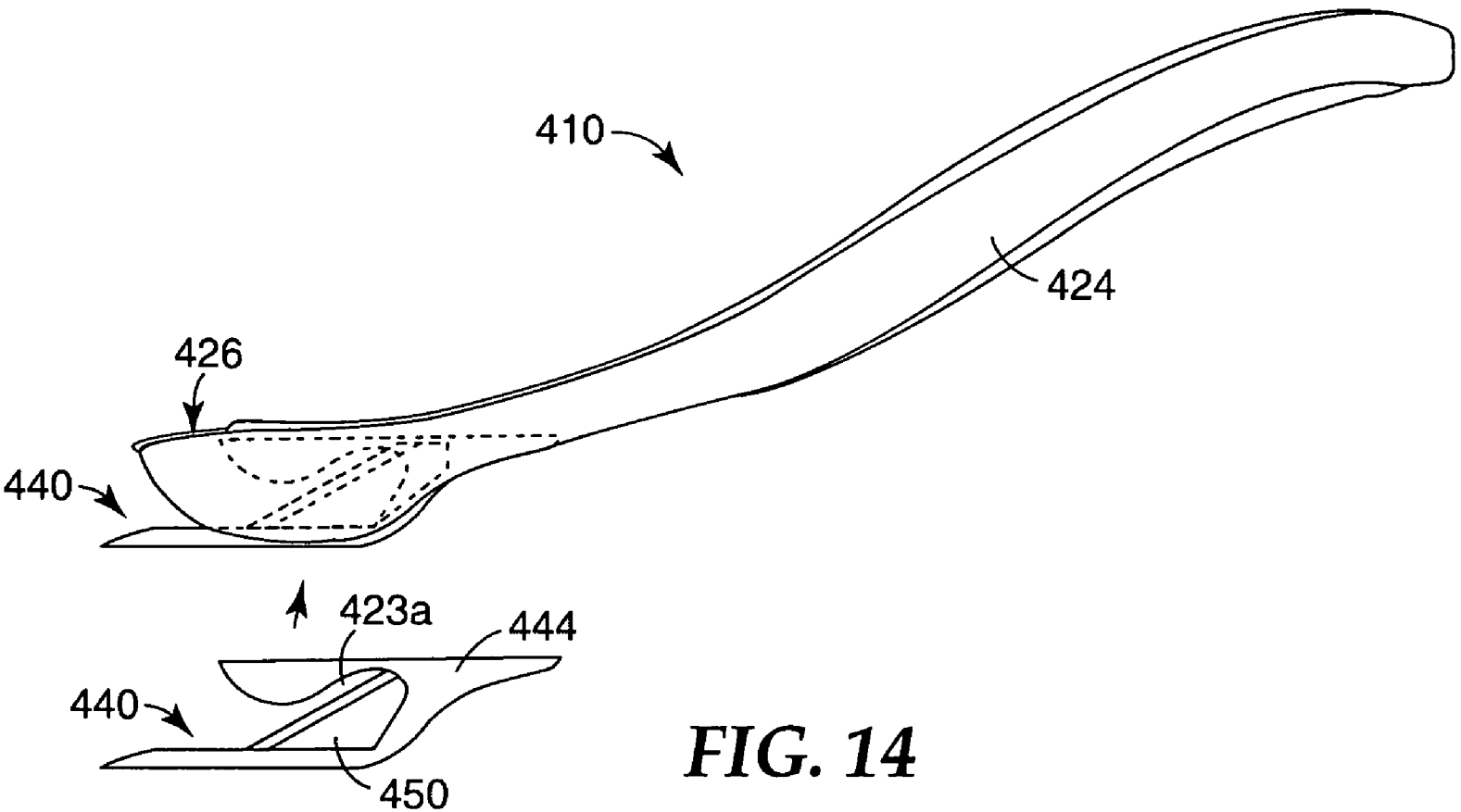
FIG. 14 is a side view of another embodiment showing a cutting device with replaceable parts.

FIG. 14 shows another illustrative embodiment where the guide is replaceable. Cutting device 410 includes handle 424 and replaceable guide 440 having blade 450. The replaceable guide further includes second media contact point 423*a*. Once the guide is attached to housing 426, the second media contact point lies proximate to the cover of the housing.

In one embodiment, the handle, housing, and guide are integrally formed. It is within the scope of the present invention, however, for the components to be formed separately and joined together by any suitable means. Whether or not integrally formed, the body may be made of any variety of materials, including metal, wood, polymer, ceramics and composites thereof. Injection moldable polymers are also useful. Suitable polymers include, but are not limited to polyolefins, such as, but not limited to polypropylene, polystyrene, high impact polystyrene, and ABS (acrylonitrile-butadiene-styrene copolymer). The cutting device can be injection molded as one piece or can be molded as with multiple parts that could be assembled together. The body could be made of a combination of polymers. For example, in one embodiment, the body could be made of two polymers, one of which is softer, in terms of durometer, than the rest of the body, so as to provide a soft touch effect.

The means for cutting the media may be a blade or a wire made from a variety of materials, including metals, ceramics, and plastics. Suitable metals include, but are not limited to, stainless steel, cold rolled steel, cold rolled nickel plated steel, copper and brass. The cutting edge may be a straight edge or it may be beveled, chiseled, serrated, corrugated, scalloped, or curved. The means for cutting the media may be of any number of geometries, including e.g., triangular, rectangular or circular. The circular geometry can be advantageous in that if the cutting edge becomes dull, the device can be designed so as to rotate the cutting edge to expose a fresh cutting edge. This design feature extends the life of the blade or wire without having to replace it. An advancing mechanism can be designed into the body to allow for rotation of the cutting edge. Yet another design would include a swivel blade with a ball joint and a lock. In yet another embodiment, the means for cutting the media can include two rounded wheels that make contact with one another and where the cutting action occurs as the wheels rotate against one another.

The means for cutting the media can include a plurality of blades or wires. In one embodiment, two blades spaced apart at a desired distance, such as, e.g., ¼ inch (2.54 mm), can be used to cut predetermined widths of strips of media. The device can be designed so as to allow for passage of the strips.

Although specific embodiments of the present invention have been shown and described, it is understood that these embodiments are merely illustrative of the many possible specific arrangements that can be devised in application of the principles of the invention. Numerous and varied other arrangements can be devised in accordance with these principles by those of ordinary skill in the art without departing from the spirit and scope of the invention. Thus, the scope of the present invention should not be limited to the structures described in this application, but only by the structures described by the language of the claims and the equivalents of those structures.

What is claimed is:

1. A device for cutting media comprising:

a body comprising a handle, a cover extending from the handle to an exposed end and a sidewall nonmoveably connected with and extending from the body to a free end;

a guide having opposing top and bottom surfaces and an attached end and a free end, wherein the attached end of the guide extends from the body; and means for cutting the media disposed in the body, the means for cutting comprising a cutting edge having a leading edge and a trailing edge;

wherein the sidewall shrouds at least a portion of the cutting edge, and with reference to the cutting edge, the sidewall has a media contact point that is disposed away from the trailing edge in the direction of the leading edge, and the media contact point of the sidewall does not extend beyond the bottom surface of the guide;

wherein the bottom surface of the guide is below the free end of the sidewall;

wherein a portion of the sidewall is below the top surface of the guide;

wherein the handle terminates at a handle end opposite the cover, and further wherein the attached end of the guide is located longitudinally between the handle end and the exposed end of the cover, and further wherein extension of the guide from the attached end to its free end is in a direction away from the handle end such that a longitudinal distance between the free end and the handle end is greater than a longitudinal distance between the attached end and the handle end, and is greater than a longitudinal distance between the exposed end of the cover and the handle end;

wherein when the origin of a Cartesian coordinate system coincides with the leading edge of the cutting edge and the x-z plane lies substantially coplanar with the top surface of the guide, the trailing edge of the cutting edge lies in the positive y direction;

and wherein, during cutting, the cutting edge and the sidewall exert sufficient frictional forces on the media to create a deformation in the media near the leading edge of the cutting edge such that a user does not need to cut the media on a supporting substrate.

2. The device of claim 1, wherein the media contact point of the sidewall lies between the leading edge and the trailing edge.

3. The device of claim 1, wherein the body and the sidewall are integrally formed.

4. The device of claim 1, wherein the cover is transparent.

5. The device of claim 1, wherein the device further comprises a visual indicator selected from the group consisting of (i) a reference mark on the cover and (ii) a reference mark on the guide.

6. The device of claim 1, wherein the free end of the guide extends beyond the exposed end of the cover.

7. The device of claim 1, wherein the free end of the guide has a substantially rounded geometry or substantially a pointed geometry.

8. The device of claim 1, wherein a bottom surface of the guide has a widest width that is larger than the widest width of the sidewall.

9. The device of claim 1, wherein the guide further comprises a rib extending from the bottom surface or a side surface.

10. The device of claim 1 wherein the media contact point is below the top surface of the guide.

11. A media cutting device comprising:

a body comprising an elongated handle, a cover having a planar region and being nonmoveably connected with and extending from the handle to an exposed end, and a sidewall extending from the cover to a free end;

a guide disposed generally beneath the cover, the guide having opposing top and bottom surfaces, an attached end, a free end; and a blade disposed in the guide, the blade comprising a cutting edge having a leading edge and a trailing edge, wherein the sidewall shrouds at least a portion of the blade and with reference to the blade, the sidewall comprises a media contact point that is disposed away from the trailing edge in the direction of the leading edge;

wherein the bottom surface of the guide is below the free end of the sidewall;

wherein the media contact point is below the top surface of the guide but does not extend beyond the bottom surface of the guide;

wherein when the origin of Cartesian coordinate system coincides with the leading edge of the cutting edge and the x-z plane lies substantially coplanar with the top surface of the guide, the trailing edge of the cutting edge lies in the positive y direction;

wherein the handle terminates at a handle end opposite the cover, and further wherein the attached end of the guide is located longitudinally between the handle end and the exposed end of the cover, and further wherein extension of the guide from the attached end to the free end is in a direction away from the handle end such that a longitudinal distance between the free end and the handle end is greater than a longitudinal distance between the attached end and the handle end, and is greater than a longitudinal distance between the exposed end of the cover and the handle end;

and wherein, during cutting, the cutting edge and the sidewall exert sufficient frictional forces on the media to create a deformation in the media near the leading edge of the cutting edge such that a user does not need to cut the media on a supporting substrate.

12. The device of claim 11, wherein the media contact point of the sidewall lies between the leading edge and the trailing edge of the blade.

13. The device of claim 11, wherein the handle, cover, and sidewall are integrally formed.

14. The device of claim 11, wherein when the device is engaged with the media so as to cut it, the media does not contact an inner surface of the cover.

15. The device of claim 11, wherein the blade disposed in the guide such that the leading edge lies proximate to the top surface of the guide and the trailing edge lies proximate to the attached end of the guide.

16. The device of claim 11, wherein the free end of the guide has a substantially rounded geometry or a substantially pointed geometry.

17. The device of claim 11, wherein the guide further comprises a rib extending from the bottom surface or side of the guide.

* * * * *